United States Patent [19]

Fröhlich

[11] Patent Number: 4,801,222

[45] Date of Patent: Jan. 31, 1989

[54] PRESSURE-TIGHT PIPE CONNECTION FOR A DRIVEN PIPELINE

[75] Inventor: Herbert Fröhlich, Bad Reichenhall, Fed. Rep. of Germany

[73] Assignee: Dyckerhoff & Widmann Aktiengesellschaft, Fed. Rep. of Germany

[21] Appl. No.: 80,747

[22] Filed: Jul. 31, 1987

[30] Foreign Application Priority Data

Aug. 8, 1986 [DE] Fed. Rep. of Germany ..... 3626988

[51] Int. Cl.[4] ..... F16L 1/02

[52] U.S. Cl. ..... 405/184; 285/345; 254/29 R; 405/154

[58] Field of Search ..... 405/184, 251, 252, 154, 405/250–257; 285/345, 231; 254/29 R

[56] References Cited

U.S. PATENT DOCUMENTS

| | | | |
|---|---|---|---|
| 2,488,245 | 11/1949 | Smith | 285/345 X |
| 3,054,627 | 9/1962 | Ligon | 285/345 X |
| 3,585,803 | 6/1971 | Bardgette | 405/251 |
| 3,990,730 | 11/1976 | Ekman | 285/345 X |
| 4,565,381 | 1/1986 | Joelson | 285/345 X |
| 4,594,027 | 6/1986 | Becker | 405/184 X |
| 4,653,594 | 3/1987 | Yamamoto et al. | 405/184 X |

*Primary Examiner*—Dennis L. Taylor
*Attorney, Agent, or Firm*—Toren, McGeady & Associates

[57] ABSTRACT

A steel pipeline to be driven through an earth section without disturbing the overlying earth is made up of a plurality of serially arranged axially extending pipe sections each having a leading end and a trailing end. The leading end of each pipe section abuts the trailing end of the pipe section previously driven into the earth section. A pressure-tight pipe connection between the abutting ends of the pipe sections is formed by a steel ring secured within the trailing end of the pipe section and projecting axially out of the trailing end. The steel ring has an outside diameter smaller than the inside diameter of the section. The leading end of the next pipe section has an elastic material sealing ring secured to its inside surface with the sealing ring projecting radially inwardly beyond the outside surface of the steel ring. The steel ring contacts the sealing ring and deforms it into a pressure-tight seal when the leading end of the next pipe section abuts tightly against the trailing end of the previously driven pipe section. The pipe connection permits angular deviation between the axes of the pipe sections with stops located in the pipe section affording a shear force lock between the abutting pipe sections.

8 Claims, 1 Drawing Sheet

PRESSURE-TIGHT PIPE CONNECTION FOR A DRIVEN PIPELINE

BACKGROUND OF THE INVENTION

The present invention is directed to a pressure-tight connection for serially arranged pipe sections of a driven pipeline where the pipeline is driven through an earth section without disturbing the overlying earth. Each pipe section includes a leading end and a trailing end with the leading end of one pipe section abutting against the trailing end of the previously driven pipe section in a pressure-tight manner.

For constructing a pipeline with an inside diameter of about 1000 mm in earth section where the overlying earth is not disturbed, the pipeline can be formed using earth cutting or earth moving procedures. Immediately following the formation of a cavity in the earth, protective pipe sections are drawn or pressed into the cavity produced by the earth removal operation. Often thin wall pipes, usually formed of steel, must be driven into the earth and subsequently lining pipes are placed within the driven pipe sections. The annular space between the pipe sections and the lining sections is subsequently filled. The driven pipe sections cannot be regained they remain in the earth.

These driven pipe sections, which cannot be recovered, must be designed and connected to one another so that they can be driven forwardly following one another in the manner of a link chain into the underground cavity produced in the earth removal operation. Where the pipeline is driven below the ground water table, a pipe connection is required which is sealed against the head of ground water and also affords the safe absorption of any possible transverse or shearing forces.

SUMMARY OF THE INVENTION

Therefore, the primary object of the present invention is to provide a pipe connection between individual pipe section of a steel pipeline driven through an earth section below the ground level so that the driven pipe sections move forwardly into the cavity formed in the earth moving operations with the pipe connection affording a seal against a head of water and also assuring adequate protection against transverse or shearing forces.

In accordance with the present invention, the trailing end of a pipe section is provided with a steel ring within its inside surface with the outside diameter of the ring being smaller than the inside diameter of the pipe section. The steel ring is secured to the inside surface of the pipe sections and projects in the direction opposite to the driving direction out of the trailing end. Preferably, the steel ring can be welded to the inside surface of the pipe section. The axially extending outside surface of the steel ring forms a sealing surface with a sealing ring located within the leading end of the following or next pipe section to be driven. Preferably, the sealing ring is positioned against the inside surface of the leading end of the pipe section and abuts against a shoulder.

The shoulder can be formed as a sheet steel ring secured, preferably by welding, to the inside surface of the following pipe section adjacent its leading end.

In the pipe connection viewed in the axial direction of the pipeline, the steel ring has an angularly shaped cross section with one leg extending in the axial direction of the pipe section and the other leg in the form of a flange extending perpendicularly of the axis of the pipe section with the radially outer end of the flange fixed to the inside surface of the pipe section. The trailing end of the leg extending in the axial direction can be provided with a sloping surface at its end which extends into the leading end of the following pipe section.

Preferably, a stop is provided in the region of the joint between the pipe sections for preventing lateral displacement of the pipe section ends. The stops can be in the form of small guide blocks secured to the outside surface of the steel ring and equi-angularly distributed around its circumference. The ends of the guide blocks facing opposite to the driving direction can have an inclined surface relative to the pipeline axis. At the leading ends of the pipe sections a bevel can be provided on the outside surface.

The sealing ring is a deformable member and includes a support section which bears against the inside surface of the pipe section and includes a radially inwardly directed abutment bead extending approximately perpendicularly to the support section and projecting inwardly from the support section. The bead is located in the path of the steel ring on the previously driven pipe section and has an inclined surface arranged to contact the outside surface of the steel ring. The inwardly projecting bead and the inside surface of the support section adjoining it, form a recess defining an angle of, at the most, 90°. When the steel ring projecting from the trailing end of the pipe section contacts the bead it deforms it into the angular recess, doubling over the bead against the inside surface of the support section and completing the seal.

The advantage of the present invention is the manner in which the required sealing surfaces of the pipe connection are formed in a simple manner while maintaining a pressure-tight connection joint between serially adjoining pipe sections which also affords a certain amount of angular displacement between the axes of the pipe sections. In addition, the connection includes stops incorporated in a simple manner with the sealing means for assuring an adequate protection against transverse or shearing forces.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
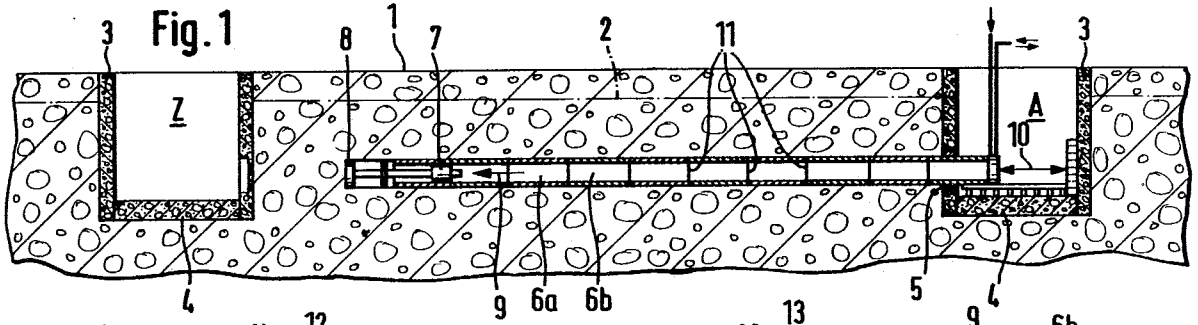
FIG. 1 is a schematic showing of the operation of driving a pipeline formed of individual pipe sections between a starting shaft and a terminal shaft and illustrated in cross-section.

As shown in FIG. 1, two shafts are required for driving a pipeline underground, a starting or driving shaft A and a terminal shaft Z. The pipeline is driven below the ground level between the shafts without disturbing the overlying ground. In other words, unlike an open cut excavation for a pipeline, in FIG. 1 the pipeline is driven through the earth by excavating or removing only that portion of the earth required to receive the pipeline. The driving shaft A as well as the terminal shaft Z can be excavated in a known manner by installing sheet piling walls or the like and then removing the soil within the walls. As shown in FIG. 1, the bottoms of the shafts are located below the ground water table 2. Each of the shafts A, Z, have a vertically extending shaft wall 3 and a base plate 4 An opening 5 for movement of the individual pipe sections from the driving shaft A into the earth between the shafts is located in the shaft walls 3. The opening 5 is provided with sliding seal.

The pipeline is driven in the arrangement shown in FIG. 1 by a drilling machine 7 with a drill head 8 at its forward or leading end. Drill head 8 is pressed against the working face of the earth in the direction of the arrow 9 by the drilling machine 7 and effects the removal of the earth by a rotational movement and/or by wash boring with water. The force required for driving the individual pipe sections 6*a*, 6*b* is provided within the driving shaft A by hydraulic presses, not shown, but indicated by an arrow 10.

Figure 2:
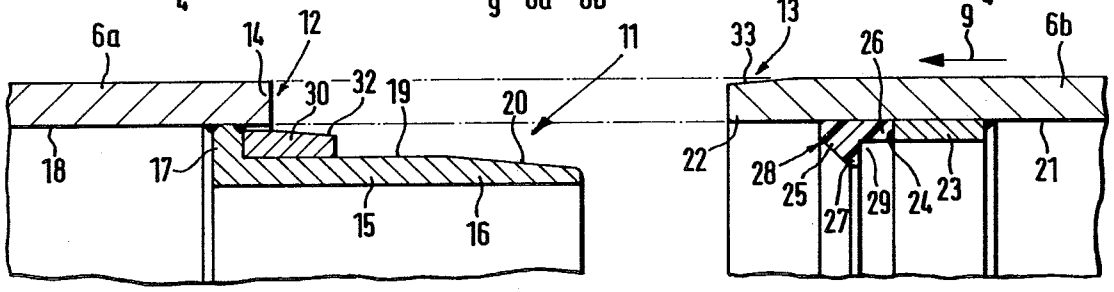
FIG. 2 is a partial sectional view through a connection between pipe sections with the sections spaced apart.
Figure 3:
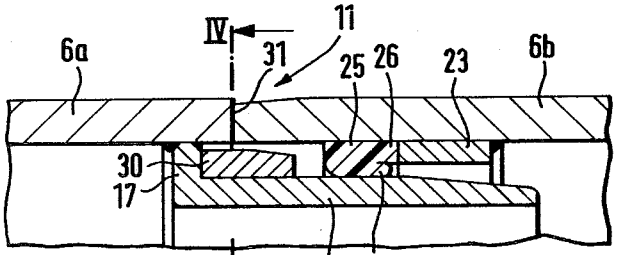
FIG. 3 is a cross-sectional view of the connection between the pipe sections in FIG. 2 after the sections have been placed into abutting contact.
Figure 4:
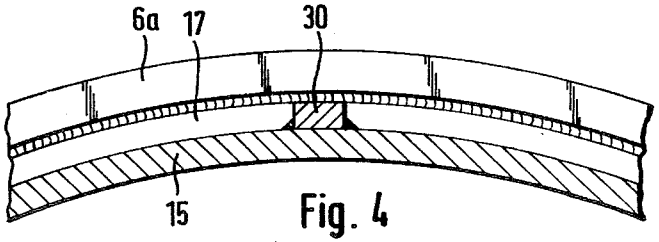
FIG. 4 is a transverse cross sectional view taken along the line IV—IV in FIG. 3.

FIGS. 2 and 3 are axially extending sectional views through a portion of a pipe joint 11 between a leading pipe section 6*a* and a trailing pipe section 6*b* relative to the driving direction 9. FIGS. 2 and 3 are shown on an enlarged scale as compared to FIG. 1. The connection of the pipe sections 6*a* and 6*b* is illustrated by the trailing end 12 of the pipe section 6*a* and the leading end 13 of the pipe section 6*b*.

The pipe connection includes a steel ring 15 fixed to the inside surface of the trailing end part of the pipe section 6*a* with the steel ring being fixed to the trailing end part 14 a short distance inwardly from the trailing end 12. In axial section, as viewed in FIG. 2, the steel ring is angularly shaped with a longer axially extending leg 16 and a shorter flange-like leg 17 with the legs extending perpendicularly to one another. Steel ring 15 is welded to the inside surface 18 of the pipe section 6*a* at the radially outer end of the shorter leg 17. The longer leg 16 has its outside surface 19 spaced radially inwardly from the inside surface 18 of the pipe section. The longer leg 16 projects axially outwardly from the trailing end 12 and the end of the outside surface has a wedge-shaped chamfer 20 with the diameter of the chamfer decreasing to the trailing end of the ring.

The leading end 13 of the following pipe section 6*b* is arranged to receive the steel ring 15 projecting from the trailing end of the forward pipe section 6*a*. Axially inwardly within the pipe section 6*b* spaced from its leading end 13 is a sheet steel ring 23 welded to the inside surface of the pipe section spaced from the leading end by the pipe section 6*b*. The steel ring 23 has a forward face facing in the driving direction spaced inwardly from the leading end of the pipe section 6*b*. Face 24 on the ring 23 forms a support shoulder for an elastic material sealing ring 25. Sealing ring 25 is formed by an axially extending section 26 which bears against the inside surface 21 of the pipe section 6*b* with the rearwardly facing end of the section abutting against support shoulder 24. In addition, a radially inwardly projecting bead 27 extends inwardly from the section 26 and the surface of the bead facing toward the leading end 13 forms an inclined chamfered surface 28 sloping rearwardly in the inward direction, that is, opposite to the driving direction 9. The rearward surface of the bead 27 and the radially inner surface of the section 26 form an angularly shaped recess 29.

The pipe connection between the pipe sections 6*a*, 6*b* is attained when the ends 12, 13 are placed in abutting relation and the steel ring 15 moves in a telescoping manner into the leading end of the following pipe section 6*b*. The connection is made when a new pipe section is introduced into the driving shaft A after a previous pipe section has been driven through the aperture 5 into the earth. As the following pipe section 6*b* is driven in the direction of the arrow 9 against the previously driven pipe section 6*a*, the inclined chamfered surface 28 of the sealing ring 25 slides over the wedge-shaped chamfer 20 on the rearward end of the steel ring 15 providing a rough centering of the pipe section 6*b* relative to the forward pipe section 6*a*. At the same time, as the sealing ring 25 moves forwardly relative to the steel ring 15, the inwardly projecting bead 27 after its passage over the chamfer 20 is deformed opposite to the driving direction in the manner shown in FIG. 3. As shown in FIG. 3, the bead 27 is pressed rearwardly closing the recess 29 so that the rearwardly directed face of the bead bears against the radially inwardly directed surface of the section 26. Accordingly sealing ring 25 acts as a compact single part sealing member.

Small guidance blocks 30 located on the outside surface of the steel ring 15 serve for the finish centering of the leading end 13 of the pipe section 6*b* as the pipe sections are moved into abutting contact. In addition, the blocks 30 provide a lock against transverse or shearing forces at the joint between the pipe sections. Blocks 30 are uniformly distributed around the outside surface 19 Of the steel ring 15 and extend from the outwardly projecting leg 17 rearwardly from the trailing end 12 of the pipe section 6*a*. The abutting ends of the pipe section 6*a*, 6*b* form a joint 31. Preferably, the small guidance blocks are welded to the steel ring 15. The outer surface at the ends of the blocks which extend into the leading end of the following pipe section 6*b* have a wedge-shaped chamfer 32 which can slide on the inside surface of the leading end section 22 of the pipe section 6*b* when the steel ring 15 moves in a telescoping manner relative to the sealing ring 25.

Since the shearing force lock afforded by the invention cannot always assure freedom of play, the leading end 13 of the pipe section 6*b* is provided on its outside surface with an axially extending sloping surface 33 to assure that there is no increase in the sliding resistance as the pipe section 6*b* is driven into the earth between the shafts A, Z. This sloping surface 33 is effective if there is any slight transverse displacement between the pipe sections during the subsequent driving operation.

Since the axis of the driven pipeline is not necessarily rectilinear, slight angular displacements at the pipe joints cannot be avoided. Accordingly, it is preferable to provide an intermediate layer of an elastoplastic deformable material, such as a paper seal, in the joint 31 between the abutting ends of the pipe sections 6*a*, 6*b*.

While specific embodiments of the invention have been shown and described in detail to illustrate the application of the inventive principles, it will be understood that the invention may be embodied otherwise without departing from such principles.

I claim:

1. A pressure-tight pipe connection for a pipeline driven through an earth section below the ground level thereof without disturbing the overlying earth, comprising a plurality of serially arranged axially extending similar pipe sections, each said pipe section comprising a leading end and a trailing end with the trailing end of one pipe section being abutted in a pressure-tight manner by the leading end of the next pipe section as said pipeline is driven, wherein the improvement comprises that each said pipe section has an axially extending inside surface, a steel ring located within and fixed to the inside surface of the trailing end of said pipe section, said steel ring is coaxial with said pipe section and has an axially extending outside surface with a smaller diameter than the inside surface of said pipe section, said ring extends out of the trailing end of said pipe section so that said ring projects axially into the leading end of the following pipe section, an elastic material sealing ring secured to the inside surface of said pipe section and projecting radially inwardly therefrom for a dimension greater than the difference between the inside surface of said pipe section and the diameter of the outside surface of said ring whereby the outside surface of said ring contacts the inwardly projecting said sealing ring, said sealing ring bears against the inside surface of said pipe section and the end of said sealing ring more remote from the leading end of said pipe section abuts against a shoulder fixed to the inside surface of said pipe section, said steel ring has angularly shaped cross-section in axially extending section and has one leg extending in the axial direction of said steel ring with a first end located within said pipe section spaced from the trailing end thereof and a second end spaced axially outwardly from the trailing end of said pipe section, and a second leg extending perpendicularly to the axis of said ring and forming a flange projecting radially outwardly from the first end of said first leg, and the radially outer end of said flange is fixed to the inside surface of said pipe section with said flange spaced inwardly from the trailing end of said pipe section.

2. A pressure-tight pipe connection, as set forth in claim 1, wherein the second end of the one leg of said steel ring has an axially extending wedge-shaped camber on the outside surface thereof.

3. A pressure-tight pipe connection, as set forth in claim 1, wherein in stop means for preventing transverse displacement of the abutting ends of said pipe sections is provided in the region of said pipe connection.

4. A pressure-tight pipe connection, as set forth in claim 3, wherein said stop means comprises a plurality of small guidance blocks secured to the outside surface of said steel ring and distributed uniformly around the circumference of said steel ring with said blocks arranged to project from the trailing end of said pipe section and to fit into the leading end of the following pipe section.

5. A pressure-tight pipe connection, as set forth in claim 4, wherein said small guidance blocks each have an end projecting outwardly from the trailing end of said pipe section with a wedge-shaped chamfer formed on the outside surface of said projecting end.

6. A pressure-tight pipe connection, as set forth in claim 1, wherein the leading end of said pipe section is provided with an axially extending sloping surface on the outside surface thereof with the sloping surface inclined inwardly toward the leading end.

7. A pressure-tight pipe connection, as set forth in claim 1, wherein said shoulder is formed as one surface of a sheet metal ring coaxial with and fixed to the inside surface of said pipe section adjacent to and spaced from the leading end with said shoulder facing the leading end so that said sealing ring is located between said shoulder and the leading end of said pipe section.

8. A pressure-tight pipe connection as set forth in claim 1, wherein said sealing ring has a contact section bearing against the inside surface of said pipe section an inwardly projecting bead formed on the end of said section closer to the leading end of said pipe section with said bead projecting approximately at right angles to said section, said bead having a surface extending generally transversely of the axis of said pipe section and facing toward the leading end thereof with said surface being inclined inwardly and rearwardly from the leading end, and the opposite surface of said bead in combination with the inside surface of said section of said sealing ring forming an angularly-shaped recess with the angularly shaped recess forming an angle of approximately 90°, and said bead being deformable when said pipe connection is placed in abutting contact so that said bead is deformed inwardly away from said leading end by contact with said steel ring and is pressed against the inside surface of said section of said sealing ring inwardly from said bead.

* * * * *